US005826506A

United States Patent [19]

Lin

[11] Patent Number: 5,826,506

[45] Date of Patent: Oct. 27, 1998

[54] STRUCTURE OF A STAMP

[76] Inventor: Chang Yi Lin, 56, Min Sheng Street, Fengyuan, Taichung, Taiwan

[21] Appl. No.: 759,251

[22] Filed: Dec. 2, 1996

[51] Int. Cl.[6] ..... B41F 31/00

[52] U.S. Cl. ..... 101/327; 101/405

[58] Field of Search ..... 101/327, 333, 101/334, 405, 406, 103, 104, 105, 106, 108

[56] References Cited

U.S. PATENT DOCUMENTS

| | | | |
|---|---|---|---|
| 4,841,860 | 6/1989 | Fehling | 101/334 |
| 5,048,415 | 9/1991 | Shih | 101/103 |
| 5,152,223 | 10/1992 | Mairon | 101/334 |
| 5,261,325 | 11/1993 | Bengtsson | 101/327 |
| 5,377,599 | 1/1995 | Wall et al. | 101/327 |

*Primary Examiner*—Edgar S. Burr
*Assistant Examiner*—Dave A. Ghatt

[57] ABSTRACT

An improved structure of a stamp comprises a main body, a stamp body, a press cover and two rotating lids. The stamp body has an ink compartment and a cylindrical rod, a stamping surface on the bottom, and two protrusion rods on each lateral side. The ink compartment has a protrusion piece and a blockage protrusion. The main body has a bottom surface with few holes for the stamp body to go through. The press cover has a block piece in the inner side for clipping on the surface of the stamp body, thus the press cover and the stamp body can be moved together. The cylindrical rod of the stamp body is encased by a spring. The press cover has an opening on each side for locating a sliding switch which the sliding switch has a blockage piece in the inner surface. The rotating lid has a sliding trough each at four lateral bodies and a center rod each at four vertical ends. The main body has a protrusion device on the inner surfaces at the lower part. The protrusion device has a position trough at the upper and lower side to encase the center rod of the rotating lids. Accordingly, the blockage piece of the sliding switch can be moved to the upper side of the main body to prevent the press cover from moving downwards. The rotating lids can be opened or closed according to the vertical movement of the stamp body.

5 Claims, 6 Drawing Sheets

STRUCTURE OF A STAMP

BACKGROUND OF THE INVENTION

The invention relates to a stamp. More particularly, the invention relates to an improved structure of a stamp.

The conventional refilled type stamps need to be covered with a lid at the bottom to prevention stamping on objects accidentally, thus makes it easily to get lost. While the spring contracted type are often being pressed accidentally to ruin the paper or objects.

Therefore the inventor of the present invention has made improvement on it to be more convenient for using.

SUMMARY OF THE INVENTION

An object of the invention is to provide a structure so that the lid at the bottom can be opened automatically when stamping, also closed automatically when finished.

Another object of the invention is to provide a switch which can prevent from stamping accidentally when is not intended to use.

Accordingly, the present invention mainly comprises a main body, a stamp body, a press cover and two rotating lids. The stamp body has two ink compartments and a cylindrical rod. the bottom of the stamp body is a stamping surface which has two protrusion rods on each side. The ink compartment has a protrusion piece and a blockage protrusion. The stamp body is encased in the main body through the holes of the main body, the press cover has a block piece in the inner surface to clip with the surface of the stamp body so that they can move together at the same time. The cylindrical rod is encased by a spring. The press cover has an opening on each side for locating a sliding switch which the sliding switch has a blockage piece in the inner surface. The rotating lids have a sliding trough each at four lateral bodies and a center rod each at four vertical ends. The main body has a protrusion device on the inner surfaces at the lower part. The protrusion device has a position trough at the upper and lower side to encase the center rod of the rotating lids.

Accordingly, the blockage piece of the sliding switch can be moved to the upper side of the main body to prevent the press cover from moving downwards. Since the center rods are encased in the position troughs, the rotating lids can be opened or closed according to the vertical movement of the stamp body.

BRIEF DESCRIPTION OF THE DRAWINGS

FIG. 1A is a close-up view of the protrusion device of the main body of the present invention;

FIG. 1B is a close-up view of the contraction end of the sliding switch of the present invention;

FIG. 8 is a section al view of the blockage piece being moved to the movement through;

FIG. 9 is a sectional view of the press cover being able to move upwards and downwards when the blockage piece being moved to the movement through;

DETAILED DESCRIPTION OF THE INVENTION

Figure 1:
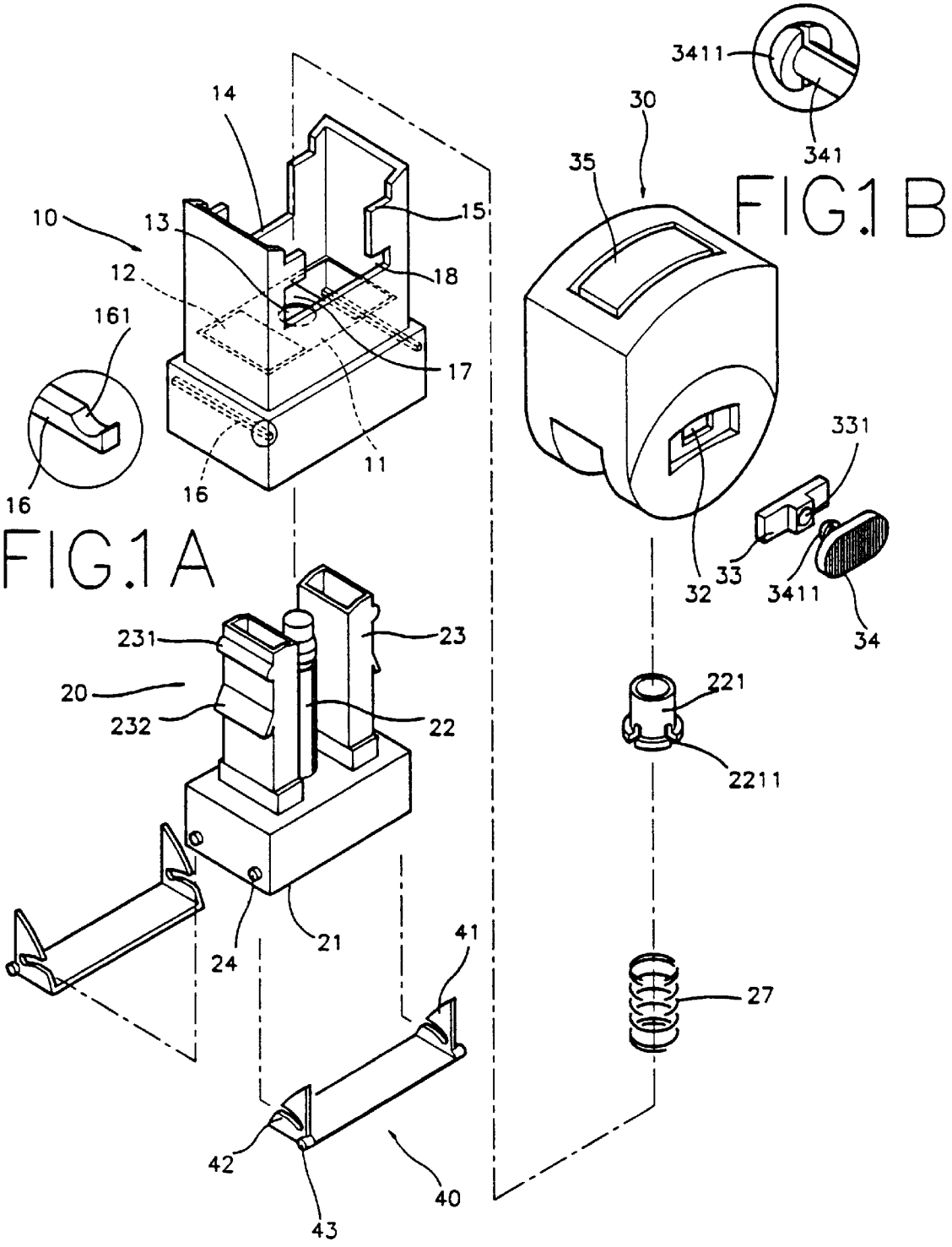
FIG. 1 is a perspective exploded view of the present invention.
Figure 2:
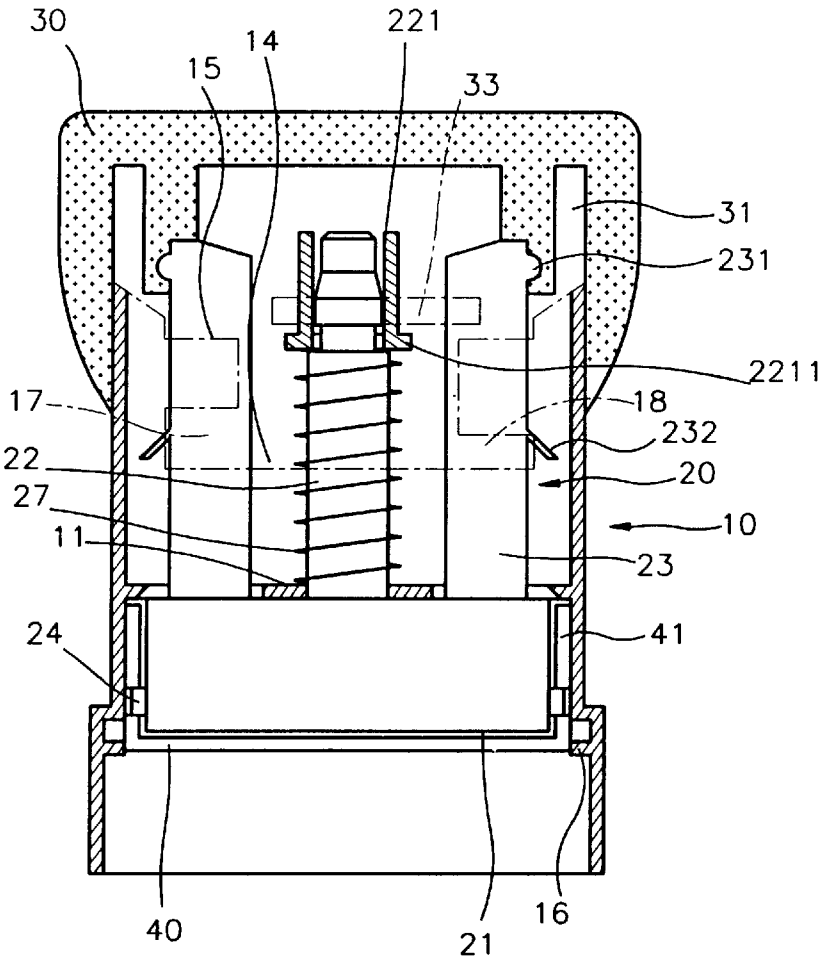
FIG. 2 is a horizontal sectional view of the present invention.
Figure 3:
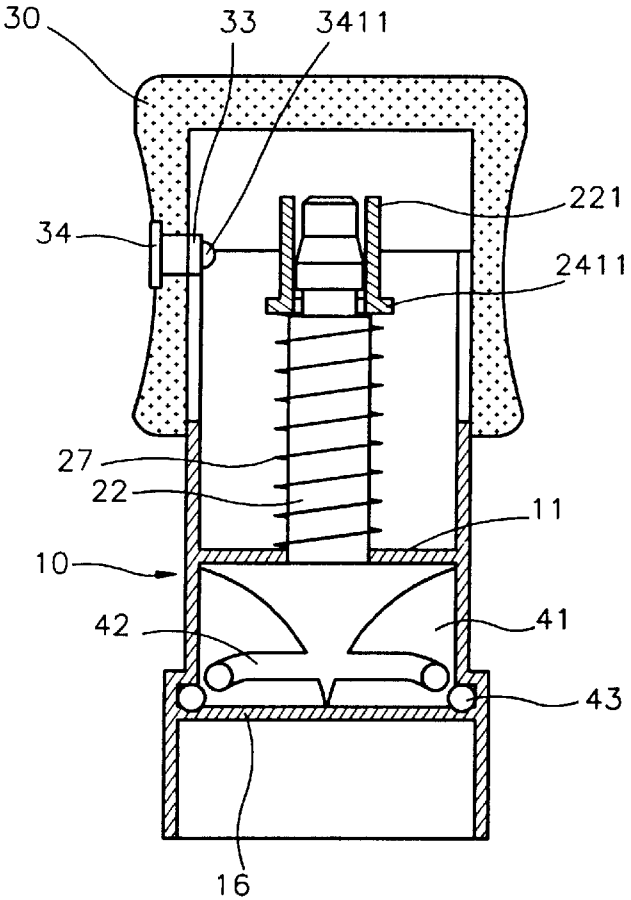
FIG. 3 is a vertical sectional view of the present invention.

Referring to Fig.1, 2 and 3, the present invention mainly comprises a main body(10), a stamp body(20), a press cover(30) and two rotating lids(40). The main body(10) can encase the stamp body(20). The bottom surface(11) of the main body(10) has two rectangular holes (12) and a circular hole(13). The upper sides of the main body(10) are in jigsaw shape with a concave trough(14), a stopping protrusion(15) at each end of the concave trough(14). A wide movement trough(17) is at one end of the concave trough(14) and a narrow stopping trough(18) at the opposite end. The movement trough(17) has more space than the stopping trough (18). The bottom part of the main body(10) is in a bigger sized rectangular shape with a protrusion device(16) at two opposite inner sides. The protrusion device(16) has a position trough (161) at one end and another position trough at the top. The stamp body(20) has a stamping surface(21) at the bottom, a cylindrical rod (22) and an ink compartment (23) on the top. The cylindrical rod(22) has a bigger diameter near the top end for an encased rod(221) to be attached to. The encased rod(221) has a clipping device(2211) at the lower end to clip firmly on the cylindrical rod(22). The ink compartment(23) can go through the rectangular hole(12) of the main body(10), the opening of the rectangular hole(12) is for refilling ink. The outer side of the ink compartment(23) has a protrusion piece (231) and a blockage protrusion(232), the blockage protrusion(232) is in triangular shape to prevent it from sliding downwards through the rectangular hole(12). The stamp body(20) has two protrusion rods(24) on each lateral side. The inner surface of the press cover(30) has a block piece(31) which has a trough for attaching to the stamp body(20) as shown in Fig.2. The press cover(30) has an opening(32) at the middle of the front side. A blockage piece(33) can be put in the opening(32) and has a hole(331) to be joined with a rod(341) of a sliding switch(34). The sliding switch(34) has a contraction end (3411). The top of the press cover(30) has a curved trough for a transparent curved cover(35) to be attached, underneath can put a paper sign for indication of the stamp characters. The two rotating lids(40) are inside the main body(10) and are attached to four protrusion rods(24) on the lateral sides of the stamp body(20). The rotating lid(40) has a triangular surface(41) at each end. The triangular surface(41) has a sliding trough (42). The rotating lid(40) has a center rod(43) at each vertical end for attaching to the position trough(161) of the protrusion device(16). The protrusion rods (24) of the stamp body(20) are attached to the sliding trough(42) of the triangular surface(41). The cylindrical rod(22) is encased by a spring(27) on top of the circle hole(13), below the clipping device (2211) of the encased rod(221).

According to the above-mentioned structure and as shown in Fig.2 and 3, the cylindrical rod(22) and the ink compartment(23) of the stamp body(20) go through the circle hole(13) and the rectangular hole(12) of the main body(10) respectively. The center rod(43) of the rotating lid(40) is attached to the position trough(161) of the protrusion device(16), the protrusion rod(24) is attached to the sliding trough (42) of the rotating lid(40). Push the press cover(30) on top of the main body(10) so that the protrusion piece(231) of the ink compartment(23) is attached to the trough of the block piece(31) at the inner side of the press cover(30).

Figure 4:
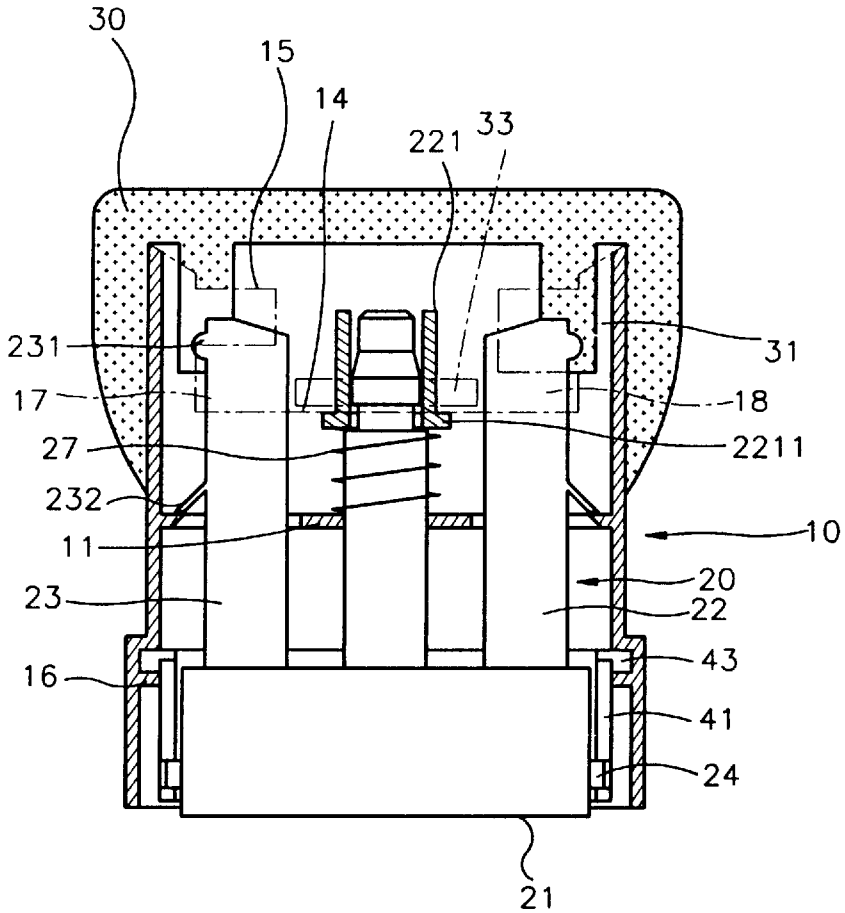
FIG. 4 is a horizontal sectional view of the present invention in motion.
Figure 5:
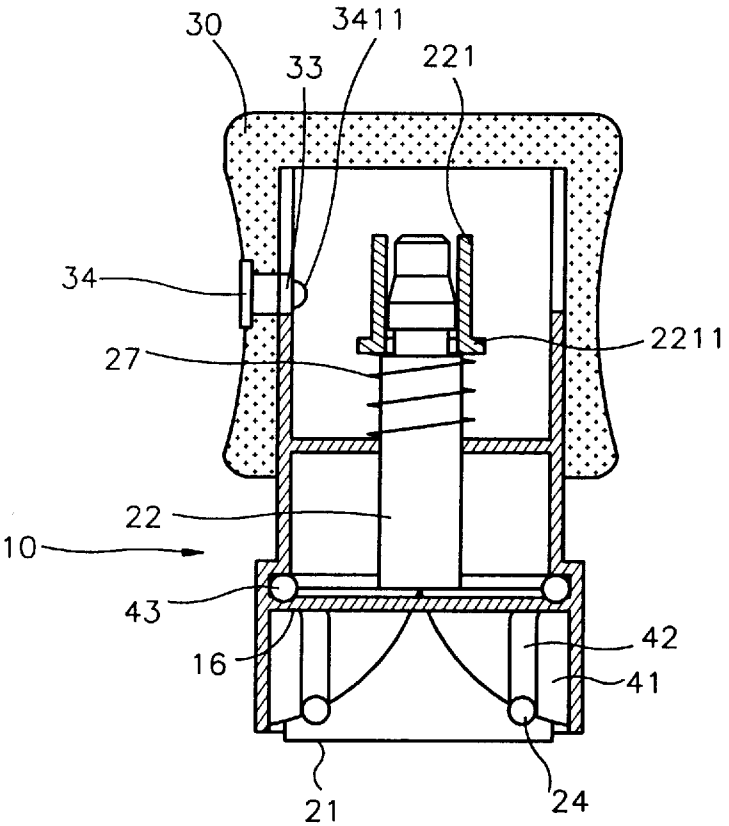
FIG. 5 is a vertical sectional view of the present invention in motion.
Figure 6:
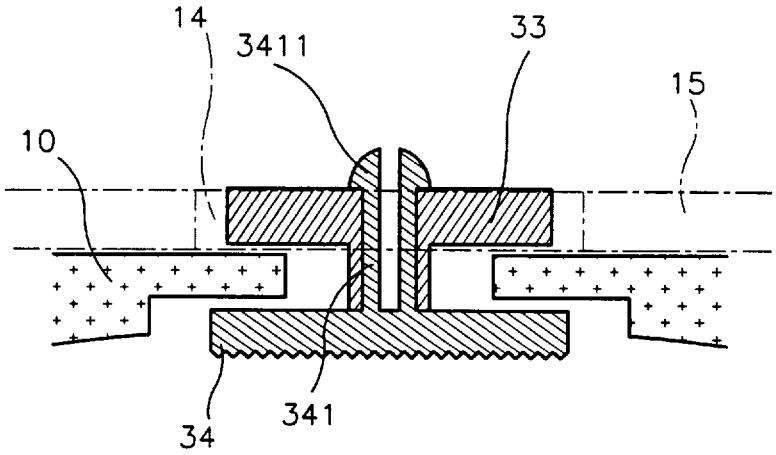
Fig. 6 is a sectional view of the sliding switch to allow the stamp body to move downwards.
Figure 7:
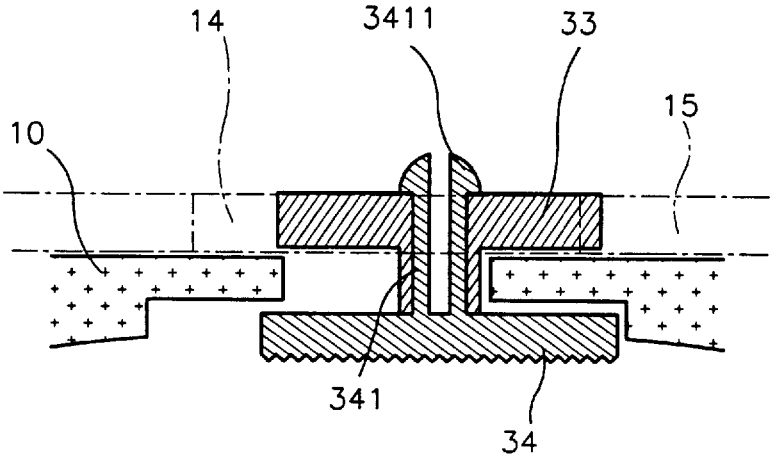
FIG. 7 is a sectional view of the sliding switch to prevent the stamp from moving downwards.
Figure 8:
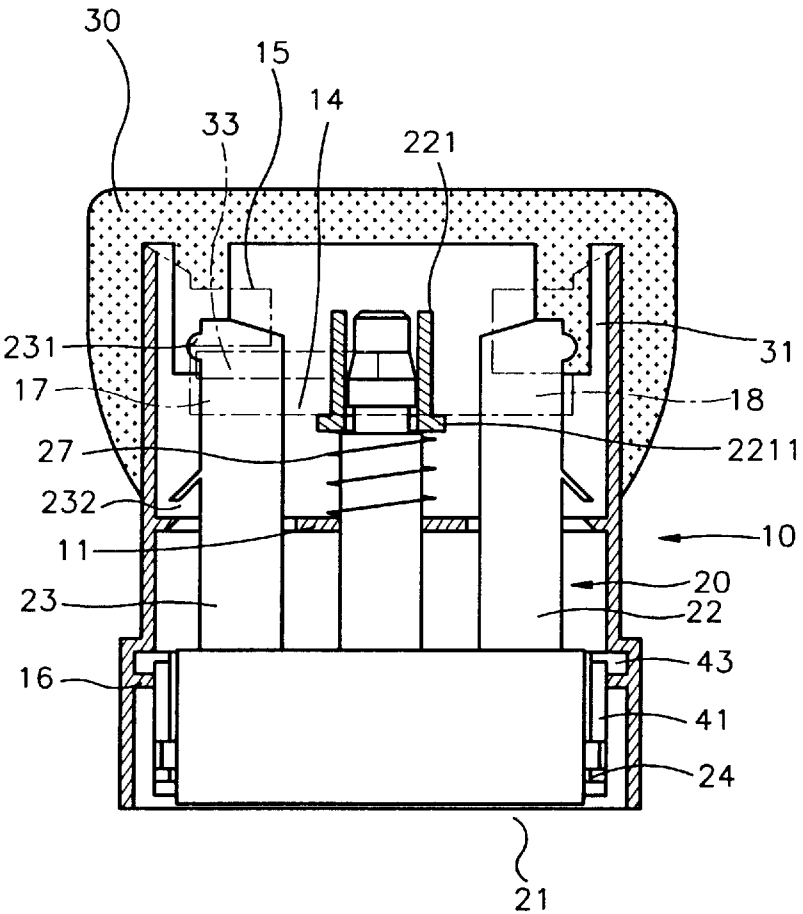
Figure 9:
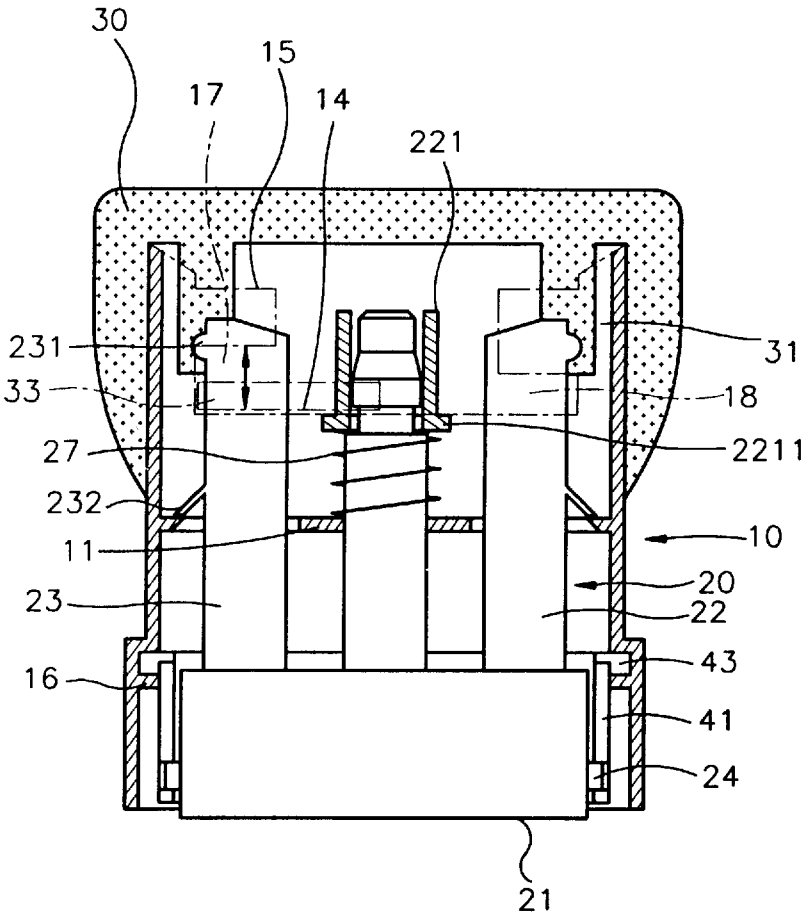
Figure 10:
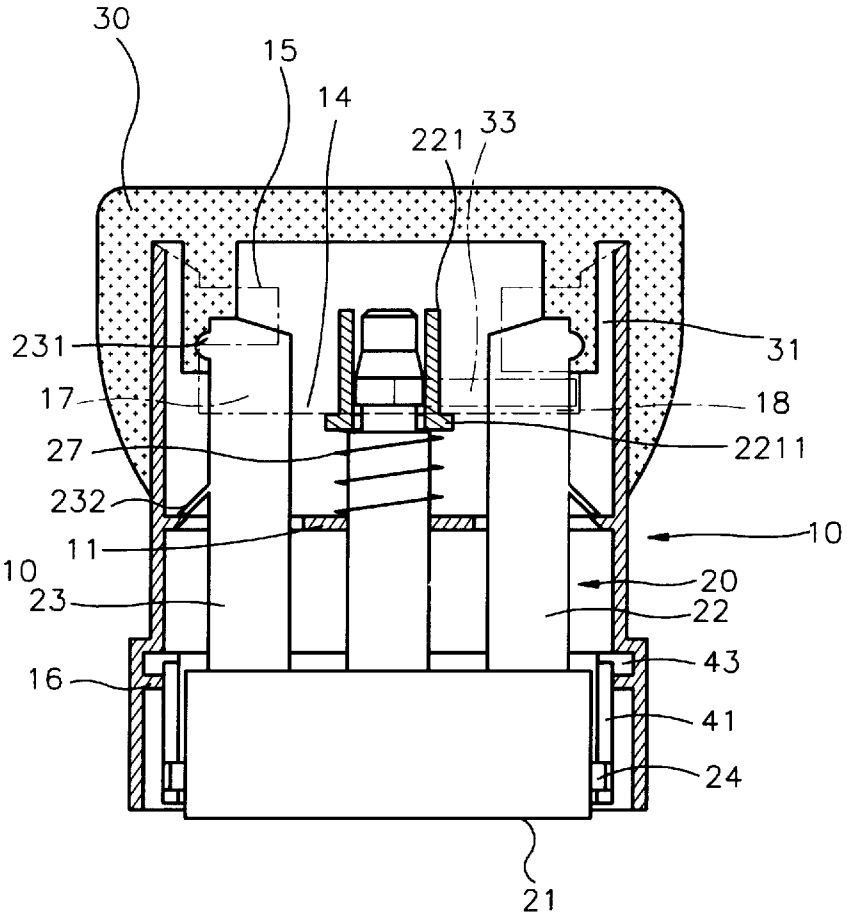
FIG. 10 is a sectional view of the stamping surface being stuck outside and not being retracted inside.

As shown in Fig. 4, 5 and 6, when the sliding switch(34) is at the middle position, the stamp body(20) goes downwards with the press cover(30) and thus allowing a stamping surface(21) to protrude outside the bottom line of the main body(10), the rotating lid(40) is in opening position due to the triangular surface(41) being pushed downwards by the protrusion rod(24) with the center rod(43) as its axis. The rotating lid(40) will be retrieved to its original closed position by the spring(27) when the press cover(30) is released and not being pressed. As shown in Fig. 2, 3 and 7, the blockage piece(33) can be slided to rest on top of the stopping protrusion(15) of the main body(10) to prevent the press cover(30) from being pressed downwards, thus control the opening and closing mechanism of the rotating lid(40). As shown Fig. 8, when the blockage piece(33) is moved to the movement trough(17), the press cover(30) and the blockage piece (33) is limited in a shorter vertical movement. As shown in Fig. 9, the stamp body(20) can be used for sequential mass stamping function due to the shorter vertical movement. As shown in Fig. 10, the stamping surface(21) will be protruded outside instead of retreiving back if the blockage piece(33) is moved to the stopping trough(18), which is convenient for mass stamping, changing stamping surface and when running out of ink. The invention is not limited to the above-mentioned embodiments but various modification thereof may be made. Futhermore, various changes in form and detail may be made without departing from the scope of the invention.

I claim:

1. An improved structure of a stamp comprising:

a main body, a stamp body, a press cover and a pair of rotating lids, the stamp body having lateral sides and an ink compartment and a cylindrical rod, the bottom of the stamp body having a stamping surface and two protrusion rods on each lateral side of the stamp body, the ink compartment having a protrusion piece and a blockage protrusion on the outer lateral side, the stamp body being encased inside the main body, the main body having a surface with a few holes, the inner side of the press cover having a block piece for attaching to the ink compartment of the stamp body for moving together, a spring, the cylindrical rod of the staamp body encased by the spring, a sliding switch , the press cover having an opening for the slding switch to go through, a blockage piece, the back of the sliding switch being attracted to the blockage piece, each rotating lid having a sliding through at each side and a center rod at each vertical end, the bottom inner side of the main body having a protrusion device, the device having a position through at each end and on the upper opposite side for attracting to the center rod of the rotating lid, the blockage piece of the sliding switch being movable to the upper side of the main body to prevent the press cover from moving downwards, the center rod of the rotating lid being attracted to the position through of the protrusion device of the main body and thus rotatable by the vertical movement of the stamp body.

2. An improved structure of a stamp as claimed in claim 1, wherein the middle position of the upper side of the main body is indented, and the side of the indention has a stopping protrusion.

3. An improved structure of a stamp as claimed in claim 1, wherein the back of the sliding switch has a contraction end to be attached to the blockage piece.

4. An improved structure of a stamp as claimed in claim 1, wherein the indented side of the main body has a movement trough which the blockage piece can be moved vertically in for a short distance.

5. An improved structure of a stamp as claimed in claim 1 or claim 4, wherein the opposite end of the movement trough of the main body has a stopping trough which is just wide enough to put in the blockage piece to stop it from moving.

* * * * *